US011649019B2

(12) United States Patent
Bina

(10) Patent No.: US 11,649,019 B2
(45) Date of Patent: May 16, 2023

(54) NAVIGATIONAL RUNNING LIGHT RETROFIT SYSTEM

(71) Applicant: Progressive Engineering Technologies, LLC, Northfield, OH (US)

(72) Inventor: David Bina, Northfield, OH (US)

(73) Assignee: Progressive Engineering Technologies, LLC, Northfield, OH (US)

( * ) Notice: Subject to any disclaimer, the term of this patent is extended or adjusted under 35 U.S.C. 154(b) by 0 days.

(21) Appl. No.: 17/364,758

(22) Filed: Jun. 30, 2021

(65) Prior Publication Data

US 2022/0001965 A1 Jan. 6, 2022

Related U.S. Application Data

(60) Provisional application No. 63/047,666, filed on Jul. 2, 2020.

(51) Int. Cl.

| | |
|---|---|
| ***B63B 45/04*** | (2006.01) |
| ***F21S 45/50*** | (2018.01) |
| ***F21S 45/10*** | (2018.01) |
| ***F21S 43/14*** | (2018.01) |
| *F21W 107/20* | (2018.01) |
| *F21Y 115/10* | (2016.01) |

(52) U.S. Cl.

CPC ..... *B63B 45/04* (2013.01); *F21S 43/14* (2018.01); *F21S 45/10* (2018.01); *F21S 45/50* (2018.01); *B63B 2201/08* (2013.01); *F21W 2107/20* (2018.01); *F21Y 2115/10* (2016.08)

(58) Field of Classification Search

CPC .. F21S 45/50; F21S 45/10; F21V 4/14; F21Y 2115/10; B63B 2201/08

See application file for complete search history.

(56) References Cited

U.S. PATENT DOCUMENTS

| | | | | |
|---|---|---|---|---|
| 9,171,436 | B1 * | 10/2015 | Covelli | G01S 19/17 |
| 2004/0095777 | A1 * | 5/2004 | Trenchard | F21S 9/035 362/555 |
| 2006/0120083 | A1 * | 6/2006 | Trojanowski | B60Q 1/2611 362/240 |

FOREIGN PATENT DOCUMENTS

WO WO-2021022145 A1 * 2/2021

* cited by examiner

*Primary Examiner* — Anabel Ton

(74) *Attorney, Agent, or Firm* — Hahn Loeser & Parks LLP; Bret A. Hrivnak

(57) ABSTRACT

Navigational running light retrofit system comprises a position tube that is inserted into a U.S. Naval specified navigational running light fixture and is further positioned, aligned and sealed using existing elements of the navigational running light fixture being retrofit. The positioning tube, having a generally tubular form, is a receiver for a commercially available LED navigational running light having cylindrical form. LED navigational running light is modified to secure a plate to the top surface of the assembly. This stabilizer plate has a similar diameter to the inner housing of the navigational running light fixture being retrofit, whereby stabilizing the retrofit system assembly when subjected to extreme mechanical shock. The positioning elements of the navigational running light retrofit system cooperate with the elements of the navigational running light fixture being retrofit to align and maintain alignment of the light exiting the fixture at the direction and angle.

19 Claims, 15 Drawing Sheets

NAVIGATIONAL RUNNING LIGHT RETROFIT SYSTEM

CROSS-REFERENCE TO OTHER APPLICATIONS

This application claims priority to, and the benefit of, U.S. Provisional Patent Application No. 63/047,666, filed Jul. 2, 2020 with the U.S. Patent Office, which is incorporated by reference.

FIELD OF INVENTION

The present invention relates to an efficient and cost-effective means to retrofit a navigational running light fixture with an LED (light emitting diode) light source, such as those used specifically on ships of the United States Navy.

BACKGROUND OF THE INVENTION

Each ship of the United States (U.S.) Naval fleet requires a specific set of navigation lights known as "running lights". A running light set, typically consists of (5) five light fixtures, namely, forward masthead, aft masthead, port side, starboard side, and stern light fixtures. Each vessel must operate this set of running light fixtures from dusk until dawn without exception. The design and manufacture of each running light fixture is unique to the U.S. Navy. The requirements for the individual running light fixtures are called out in publicly available military specifications. Each running light fixture utilizes a dual filament incandescent lamp. If a lamp filament fails, a crewmember must replace the lamp as soon as there is a safe opportunity to do so. The incandescent lamps have a typical operational life expectancy of <1,200 hours, as they are under constant vibration and are regularly subjected to mechanical shock. Crewmembers replace these lamps with high frequency. Ships installed with the U.S. Navy specified running lights will continue to replace incandescent lamps and repair existing lighting equipment, until the U.S. Navy mandates replacement/upgrade of the fixtures from the incandescent light source to a light emitting diode (LED) source. As there is no mandate, in addition to the fact that the existing navigational running light fixtures continue to meet the current requirements, active ships of the U.S. Naval Fleet will continue to use the incandescent light source technology for the foreseeable future.

As a contemplated precursor for the present invention, the present inventors have contemplated replacing each of the running light fixtures, with entirely new light fixtures utilizing an LED light source. The new LED running light fixtures would allow continuous operation of the running light fixtures set without failure for several years. The main shortcoming of this contemplated precursor is that the removal and replacement of the legacy running light fixtures, in their entirety, requires extensive manpower, new hardware (mechanical and electrical), scaffolding, crane rental and typically extensive paperwork for the removal of equipment from the ship's exterior. Complete replacement of a legacy running light set is therefore both cost and logistically prohibitive.

As a contemplated precursor for the present invention, the present inventors have also contemplated replacing the incandescent lamp of the running light fixtures with an LED lamp equivalent. The main shortcoming of this contemplated precursor is that all of the electronics, required to comply with strict U.S. Naval requirements for ship's power, electromagnetic (EMI) emissions, and mechanical shock, must fit within the envelope of the existing incandescent lamp. In addition to meeting the said U.S. Naval requirements, this contemplated LED lamp equivalent must also provide a heat source to de-ice the face of the running light in extreme cold environments. The heat source described is required to mimic the waste heat output of the incandescent lamp, which is a minimum of 25 Watts. Development of an LED lamp to meet these requirements is cost prohibitive and may not be possible with the current technology available today.

It would be desirable to provide an efficient and cost-effective solution for upgrading existing incandescent running light fixtures with LED light sources, on all active U.S. Navy ships, all U.S. Coast Guard ships, or any other boat, ship, or vessel.

SUMMARY OF THE INVENTION

The present invention provides a retrofit system for a navigational running light fixture to replace the existing incandescent light source with an LED light source (where "LED light source" and "LED light" are used interchangeably herein). The retrofit system uses mechanical constraints that cooperate in a novel way to provide and maintain proper location, alignment, mounting and sealing of an LED light within a navigational running light fixture. The navigational running light fixtures are currently installed and are required on all ships of the U.S. Naval fleet. These retrofit systems and method of retrofitting, and other apparatus and methods described herein, may be used to retrofit incandescent light fixtures on other boats, ships, and vessels other than those associated with the U.S. Navy.

An exemplary retrofit system provided by the present invention includes a novel positioning tube component with geometry that cooperates with an existing navigational running light fixture to align and position the retrofit system. The positioning tube provides features that allow installation of a sealing component that is in turn secured and seated by a securing ring component of the navigational running light fixture being retrofit. The positioning tube further provides features that align and secure a navigational LED light.

The LED light may be a commercially available product that has been modified to function within the retrofit system, or a custom or newly manufactured LED light may be provided to incorporate the modifications or features formed into the commercially available LED light. Threaded holes are added to the commercially available LED light to allow mounting of a novel stabilizer plate onto the top surface of the LED light. A stabilizer plate may be included with the retrofit system to maintain position and structural integrity of the retrofit system when subjected to extreme mechanical shock and vibration conditions experienced by the navigational running light fixtures.

The present invention also provides a method of installing the navigational running light retrofit system into an existing navigational running light fixture currently utilized on the boats, ships, and vessels, such as those of the U.S. Naval fleet. The method includes steps of (a) disassembling and removing components of the navigational running light fixture; (b) installing a positioning tube and seal; and (c) mounting the stabilizer plate to the LED light while aligning and securing the LED light to the positioning tube. A corresponding retrofit system (a retrofit kit) is also described herein, which may be used to practice any such method described herein.

One advantage provided by the retrofit system is that the existing navigational running light fixtures will not be removed from the US Navy ship. Therefore, all existing mounting means, hardware and electrical cabling will be left intact. There is no expense for replacing the existing fixtures with new mounting hardware (mechanical or electrical), scaffolding or cranes. Approval for the removal of equipment from the ship's exterior will not be required. With the significant reduction in manpower, cost and logistics, the retrofit system is a cost-effective means to convert the existing incandescent running light fixtures to an LED light sources such as those on all ships of the U.S. Naval fleet.

Another advantage of the retrofit system is that every ship (combatant and support type) of the U.S. Naval fleet utilizes the same running light fixtures. The speed at which the retrofit system can be deployed is similar to that of a crew member replacing a failed lamp in an existing running light fixture. Therefore, the entire US Naval fleet may be retrofit (upgraded to an LED light source) using this retrofit system while in port, as opposed to waiting for the ship to go into drydock or into a maintenance period. Therefore, adoption of the retrofit system at the ship level across the entire fleet is achievable.

DETAILED DESCRIPTION OF THE INVENTION

Figure 1:
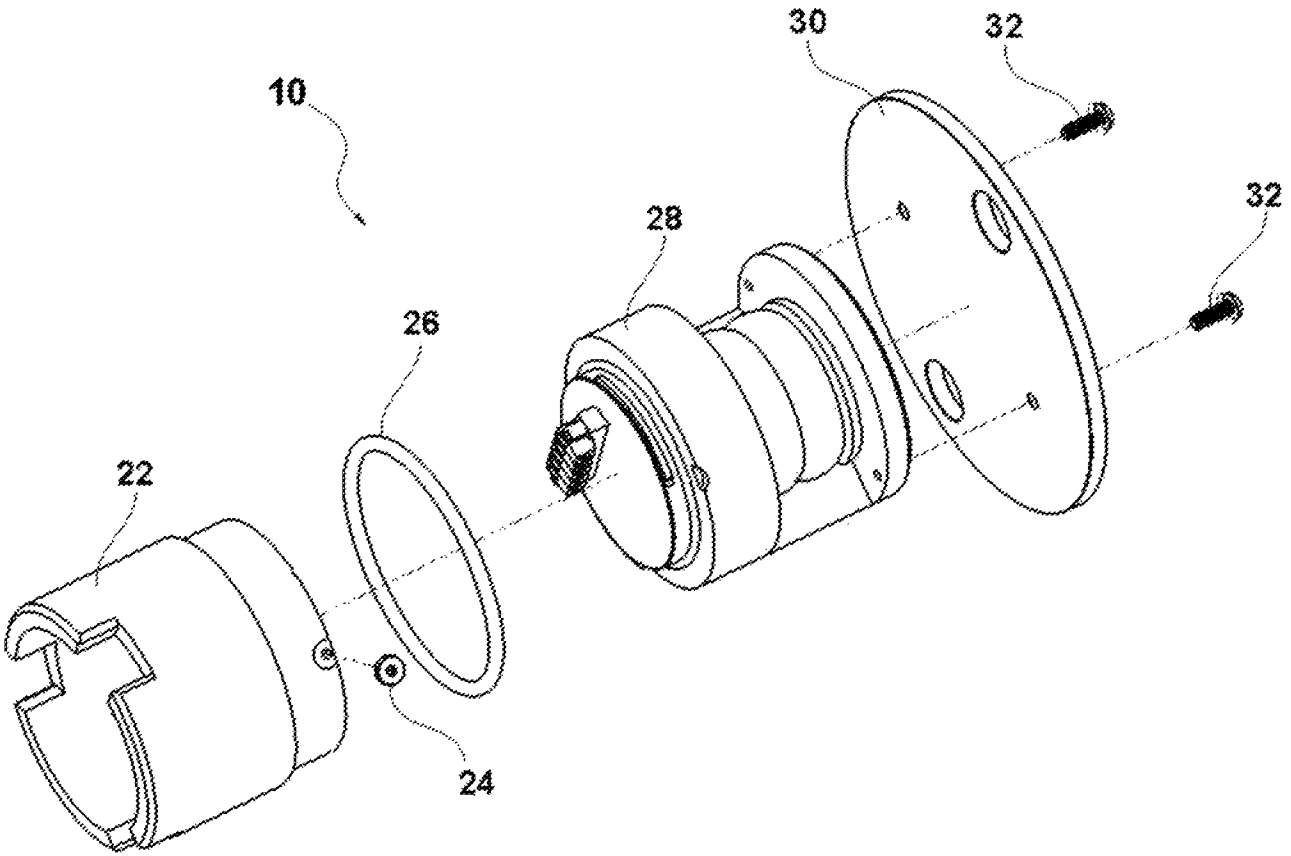
FIG. 1 is an isometric exploded view of an exemplary navigational running light retrofit system in accordance with the invention.

The following detailed description will proceed with reference to a particular, illustrated embodiment. However, the embodiment shown in the drawings is exemplary of the claimed subject matter, and should not be used to limit the scope of the invention, but rather to cover all variations and modifications obvious to a person of ordinary skill in the art.

The navigational running light retrofit system of FIG. 1 was a consideration of the inventors in developing the presently claimed invention, and by itself is not believed to constitute prior art.

This description includes features relating to (1) a navigational running light retrofit system, (2) a navigational running light fixture currently in use and specified by the US Naval fleet, and (3) a typical installation of the retrofit system into a navigational running light fixture.

Navigational Running Light Retrofit System

With reference to FIG. 1, a navigational running light retrofit system 10 in accordance with an exemplary embodiment of the invention includes: a positioning tube 22, a positioning screw 24, a seal 26, an LED light 28 (which is also referred to herein as an "LED navigational running light"), a stabilizer plate 30, and threaded fasteners 32.

Figure 2A:
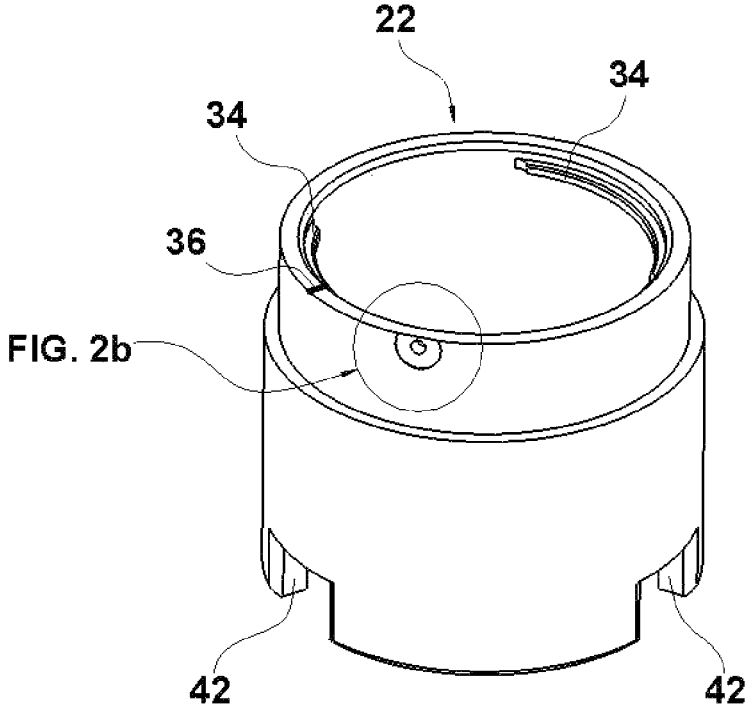
FIG. 2*a* is an isometric view of an exemplary positioning tube.
Figure 2B:
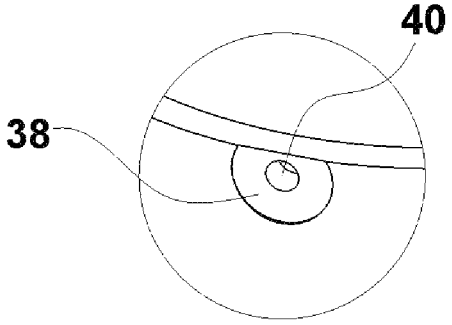
FIG. 2*b* is an enlargement of the encircled area of FIG. 2*a* labeled FIG. 2*b*.

The positioning tube 22 is shown in FIG. 2*a* as an isometric view. In this particular embodiment of the positioning tube, an inner cylindrical side defined by an internal diameter is shown with a radial helix geometry 34 protruding from the inner cylindrical side and a corresponding surface. In other words, this radial helix geometry forms an elongate protrusion extending in a helical direction but which forms only a portion of a helix, such as, for example, a segment that extends approximately 90 degrees around the inner diameter, such as to form a portion of a thread. The radial helix geometry 34 of this embodiment will allow attachment and sealing of an exemplary LED light 28 to the positioning tube 22. The radial helix geometry may be molded, machined, or otherwise formed along the inner cylindrical side using any known manner. The radial helix geometry is arranged along two substantially equal and opposite sections along the cylindrical inner tube side, although other configurations and arrangements may be employed so long as achieving the purpose of receiving and securing an LED light. Further, the inner cylindrical side of the positioning tube 22 may be constructed with various types of fastening geometry to accommodate alternate styles and manufacturers of LED lights, whether such geometry is a protrusion or a recess. To present some examples, the inner cylindrical side of the positioning tube 22 may be constructed with a fully threaded surface or with bayonet type receiver geometry to attach the LED lights of other manufacturers. A positioning notch 36 has been added to the top surface of the positioning tube 22 to provide a visual means for aligning the positioning tube 22 within a navigational running light fixture. A threaded hole 40 with a concentric flat surface 38 is constructed into the stepped outer diameter (outer surface) of the positioning tube 22 as shown in FIG. 2*b*. The threaded hole 40 is required to accommodate the positioning screw 24. The concentric flat surface 38 is of sufficient depth and diameter to allow the head of positioning screw 24 to rest in full contact against the concentric flat surface 38 once the positioning screw 24 is threaded fully into the positioning tube 22. The threaded hole 40 does not break through to the inner cylindrical side of the positioning tube 22 in order to maintain a water-tight seal of the navigational running light retrofit system 10 upon final installation into a navigational running light fixture. Also shown in FIG. 2*a* are a plurality of notches 42, and more specifically three (3) substantially equally spaced notches 42 at the base of the positioning tube 22 which are of sufficient width and depth to accurately position and resist and even substantially prevent the rotation of the positioning tube 22 within the navigational running light fixture. It is contemplated that the plurality of notches 42 may include more or less than three (3) notches. Notches 42 are also referred to herein as locating elements, which may comprise any other feature in lieu of notches. The positioning tube 22 is constructed from a rigid material, such as metal or a structurally stable polymer, and must maintain corrosion resistance in an extreme marine environment.

Figure 3A:
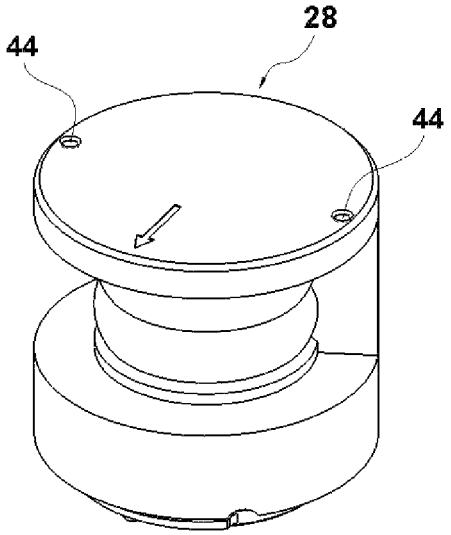
FIG. 3*a* is an isometric view of a commercially available LED running light.
Figure 3B:
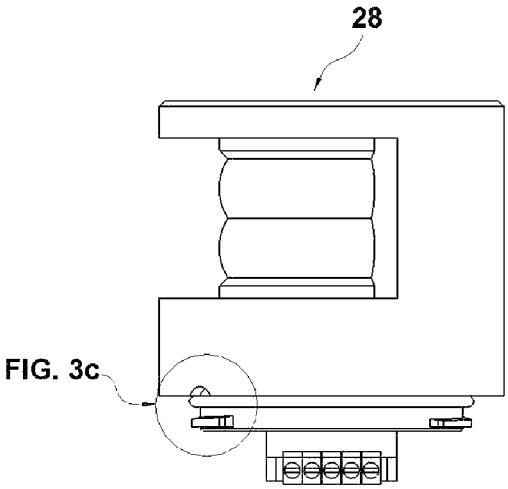
FIG. 3*b* is a side view of FIG. 3*a*.
Figure 3C:
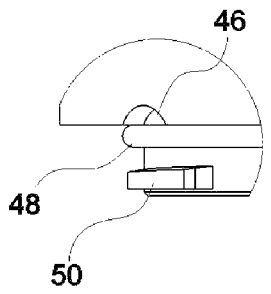
FIG. 3*c* is an enlargement of the encircled area of FIG. 3*b* labeled FIG. 3*c*.

FIG. 3*a*-3*c* show an LED light 28, used in an embodiment the navigational running light retrofit system 10. The LED light 28 is a commercially available LED type navigational light meeting the requirements of the US Coast Guard regulations for navigational running lights. Such an LED light is sold, for instance, by Lopolight ApS of Humlebaek, Denmark, as Part No. 300-138 (masthead light) or Part No. 301-108 (starboard sidelight) or Part No. 301-109 (port sidelight) or Part No. 301-105 (stern light). The LED light 28 is modified from its commercially available form, or may be manufactured originally, to include at least two equally spaced threaded holes 44, as shown in FIG. 3*a*. The threaded holes 44 are used to fasten the stabilizer plate 30 to the top surface of the LED light 28, although other means or mechanisms may be employed on other embodiments for attaching stabilizer plate to the top surface of the LED light. In this particular embodiment, the LED light 28 is constructed with radial helix geometry 50 which has been machined into two substantially equal and opposite sections to form a recessed elongate feature extending helically in a radial direction, that is, extending in a helical direction but which forms only a portion of a helix, such as, for example, a segment that extends approximately 90 degrees around the inner diameter, such as to form a portion of a thread. This radial helix geometry 50 allows attachment and sealing of the LED light 28 to the positioning tube 22 by way of mating with radial helix geometry 34 of said tube 22. It is contemplated that feature 34 may instead form a recess and feature 50 from a protrusion. Moreover, while there is two (2) of each feature 34 and feature 50 forming corresponding pairs of one another configured in mating fashion, it is contemplated that additional pairs of mating features 34, 50 may be provided in other variations. FIG. 3*c* shows an O-ring seal 48 which is installed at the base of each LED light 28. The O-ring seal 48 is also required to create and maintain a water-tight seal between the LED light 28 and the positioning tube 22 upon installation of the retrofit system into a navigational running light fixture. FIG. 3*c* also shows a circular positioning notch 46 located on the lower outer diameter, that is, the lower outer cylindrical side, of the LED light 28. The positioning notch 46 is formed at substantially the same diameter and at substantially the same depth as the concentric flat surface 38 of the positioning tube 22. Once the position notch 46 is aligned and concentric with the concentric flat surface 38 of the positioning tube 22, the head of positioning screw 24 is allowed to seat flat against both the LED light 28 and positioning tube 22. The positioning notch 46 has a radial location on the outer diameter of the LED light 28 that specifically positions the LED light 28 to the positioning tube 22, in cooperation with the fully installed positioning screw 24.

Figure 4:
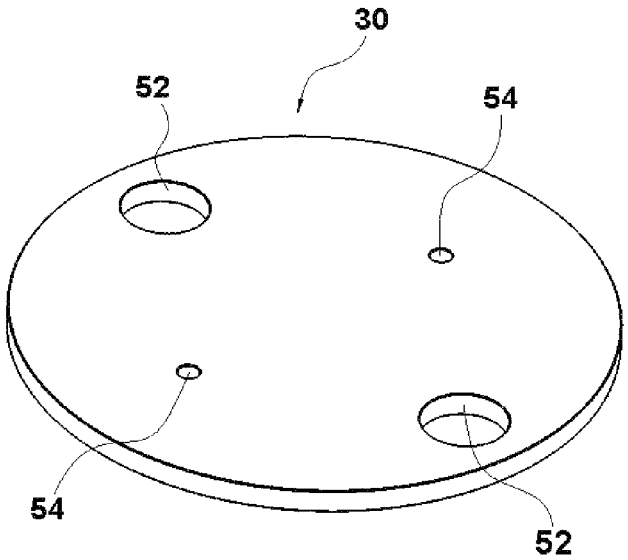
FIG. 4 is an isometric view of an exemplary stabilizer plate.

FIG. 4 shows an exemplary stabilizer plate 30 having at least two diametrically opposed finger holes 52 of sufficient size to allow the user to rotate the stabilizer plate 30 into position on the top surface of the LED light 28, during the installation of navigational running light retrofit system 10. In other variations, any other quantity of finger holes 52 may be provided. In the alternative, other features, such as any recess or protrusion, may operate as a substitute for any finger hole. The stabilizer plate 30 also provides at least two through holes 54 to allow for the insertion of threaded fasteners 32 of FIG. 1 which are required to secure the stabilizer plate 30 to the LED light 28. It is contemplated that any other quantity of fasteners 32 and corresponding holes 54 may be employed in other variations. Additionally, any other means or mechanism may be used in lieu of fasteners 32 and holes 54, such as adhesive or weldments, for example. These through holes 54 are diametrically opposed but may be of any other configuration or arrangement to achieve their stated purpose. The stabilizer plate 30 is of sufficient outer diameter to allow no more than ⅛" (0.125 inch) gap between the diameter of the stabilizer plate 30 and the inner diameter of the upper housing of the navigational running light fixture. The relationship between these diameters will be become apparent in further figures of the detailed description. The stabilizer plate 30 is constructed from a structurally rigid material, such as a metal or rigid polymer, and will maintain corrosion resistant in extreme marine environments.

Navigational Running Light Fixture (Currently in Service and Specified by the U.S. Naval Fleet)

Figure 5A:
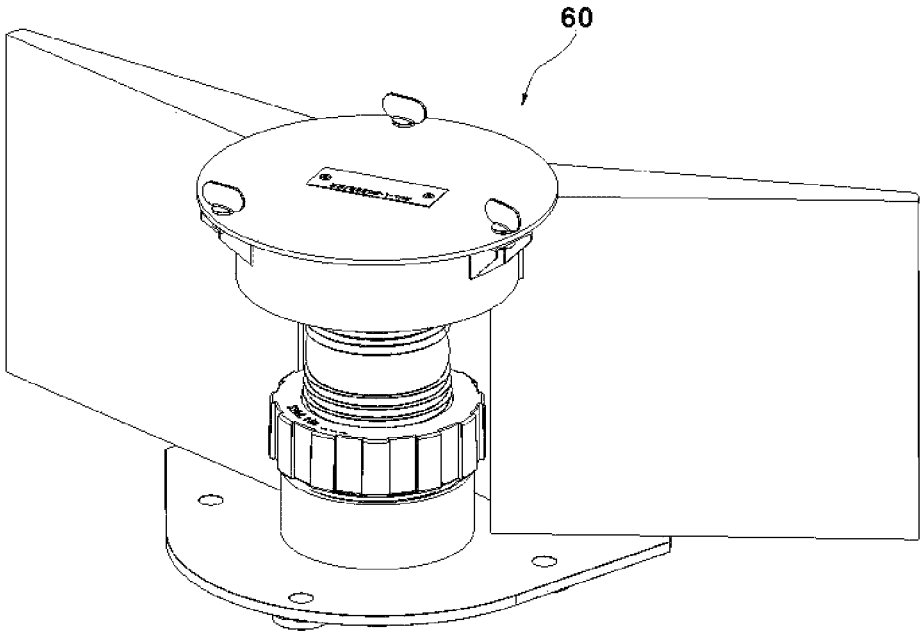
FIG. 5*a* is an isometric view of a legacy navigational running light fixture.

FIG. 5*a* shows an isometric view of a navigational running light fixture 60. These running light fixtures are currently being utilized on every ship of the US Naval fleet. FIG. 5*a* is a representation of one of six navigational light fixture variants that may be retrofit with the navigational running light retrofit system 10. The military part numbers for each of the six navigational light fixtures are indicated in U.S. military specification sheet(s) MIL-L-24560/8, MIL-L-24560/9, and MIL-L-24560/10; whereas sheet MIL-L-24560/8 specifies navigational stern light fixtures, clear (SYM 196.3), blue (SYM 196.4) and yellow (SYM 197.2) variants; whereas sheet MIL-L-24560/9B specifies navigational side light fixtures, port side red (SYM 182.2) and starboard side green (SYM 183.2) variants; whereas sheet MIL-L-24560/10 specifies the navigational masthead light fixture (SYM 172.2). There is no single manufacturer for these light fixtures. Any manufacture may build the navigational running light fixtures, or the individual components of running light fixtures, to said specifications and seek approval to supply the U.S. Navy with these fixtures for shipboard use. All referenced military specification sheets are hereby incorporated herein by reference.

Figure 5B:
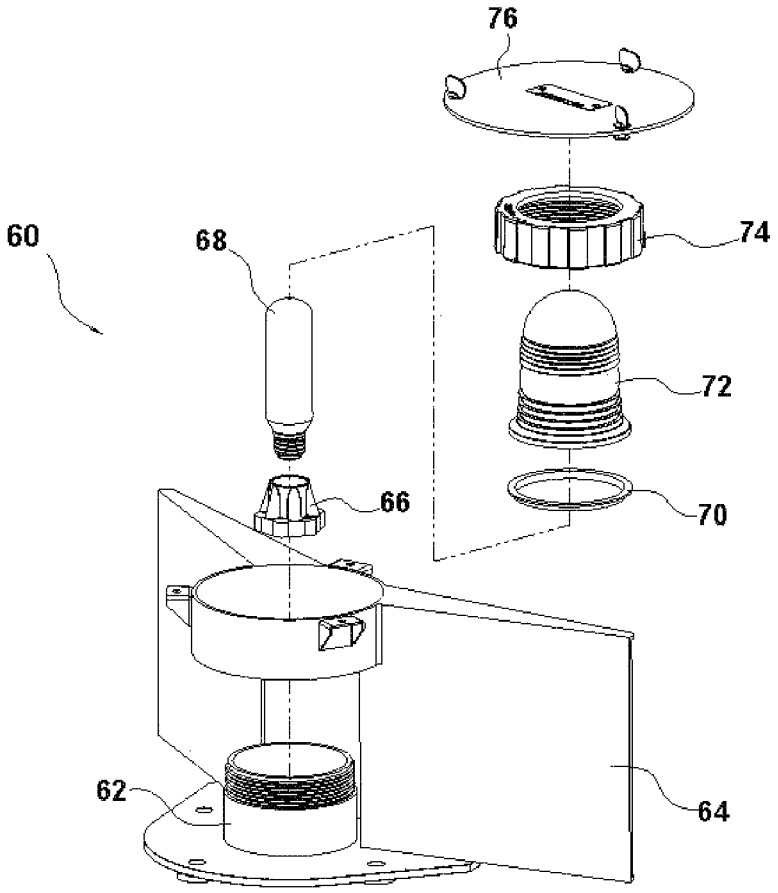
FIG. 5*b* is an exploded isometric view of FIG. 5*a*.

FIG. 5*b* is an isometric exploded view of the navigational running light fixture 60. Each navigational running light fixture 60 is composed of components (62 through 76). The differential between the six running light fixture variants is the color of the glass globe 72 and the angle of the wing like features (specifically know as side screens) of the running light fixture housing 64.

A molded plastic lighting base 62 is attached to the fixture housing 64. The lighting base 62 is a common component on all six navigational running light fixtures variants. The lighting base 62 is indicated in U.S. military specification sheet MIL-L-24560/2; U.S. military part number M24560/2-010; National Stock Number (NSN) 6220-01-185-5545. The fixture housing 64 is a fabricated aluminum assembly which includes; a housing portion, base plate and side screens. The requirements for the fabrication and dimensions of the fixture housing 64 are specified in U.S. military specification sheet(s) MIL-L-24560/8, MIL-L-24560/9, and MIL-L-24560/10.

A lamp holder 66 is attached within the lighting base 62. The lamp holder 66 is specified in U.S. military specification sheet MIL-L-970; U.S. military part number M970/6; National Stock Number (NSN) 6250-00-939-8126. The lamp holder 66 is required to hold a lamp 68. The lamp 68 is a commercially available incandescent type, dual filament; industry part number 50/50T12.

The navigational running light fixture 60 also includes a gasket 70 that is placed onto the top of the base 62. The glass globe 72 is then placed over the lamp and onto the gasket 70. The securing ring 74 is then installed over the globe 72 and threaded to the base 62. The securing ring 74 is indicated in U.S. military specification sheet MIL-L-24560/2; U.S. military part number M24560/2-011; National Stock Number (NSN) 6220-01-225-6073. The final component to be described is the fixture housing cover 76 which is placed onto the fixture housing assembly 62 and secured with quarter-turn wing nuts as shown.

Figure 6A:
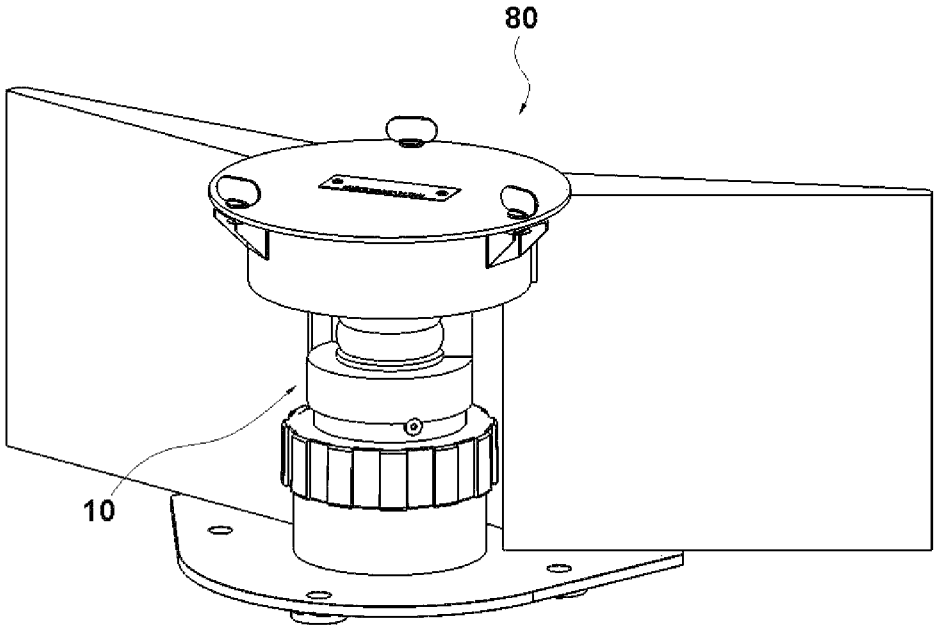
FIG. 6*a* is an isometric view of a legacy navigational running light fixture that has been retrofit with an exemplary retrofit system.
Figure 6B:
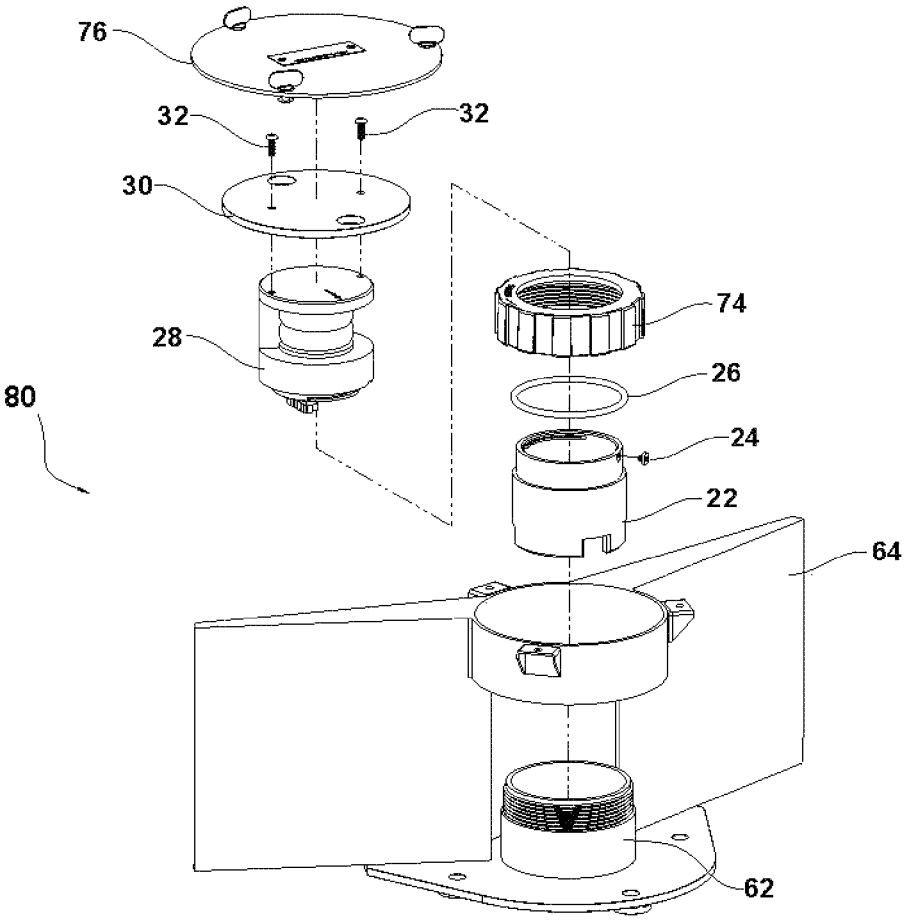
FIG. 6*b* is an exploded isometric view FIG. 6*a*.
Figure 7A:
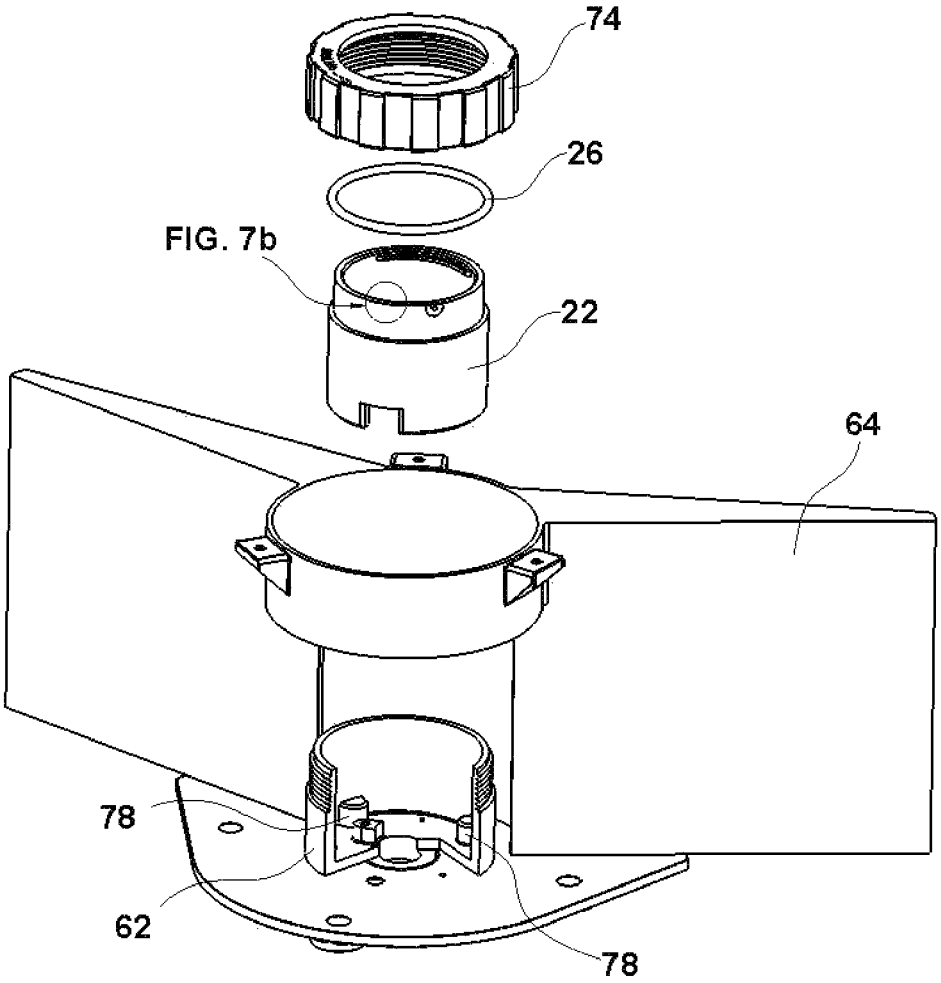
FIG. 7*a* is an isometric view of the positioning tube, seal and securing ring being installed into a legacy navigational running light fixture. The lighting base has been partially cutaway to expose the boss geometry within.
Figure 7B:
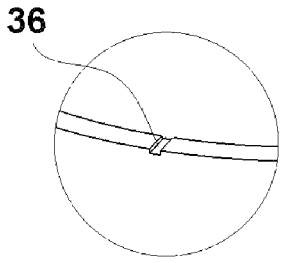
FIG. 7*b* is an enlargement of the encircled area of FIG. 7*a* labeled FIG. 7*b*.

Installation of the Retrofit System into a Navigational Running Light Fixture FIG. 6*a* shows a navigational running light fixture that has been retrofit with the navigational running light retrofit system 10. We will refer to the fully retrofit navigational running light fixture assembly as 80. FIG. 6*b* is an isometric exploded view of the navigational running light fixture assembly 80 retrofit with the navigational running light retrofit system 10. This exploded view shows the sequence in which the components (22 through 32) of the retrofit system 10, in cooperation with the components of the existing navigational running light fixture, will be installed.

During the installation of the navigational running retrofit system 10, the lamp holder 66, lamp 68, gasket 70 and globe 72 are removed from the legacy navigational running light fixture 60 (referenced in FIG. 5*a*) and further discarded. It is important to note that ship's personnel may safely access these running light fixtures to replace the lamp holder 66, lamp 68, gasket 70 and globe 72, without the use of lift equipment and can complete these maintenance tasks in a timely manner while at sea. Removal of a complete navigational running light fixture 60 from the ship structure is not possible without the use of lift equipment, additional manpower, new hardware and additional safety equipment. Further, the removal of a complete navigational running light fixture cannot be performed while at sea. The navigational running retrofit system 10 is the only known novel means to upgrade the legacy navigational running light fixture with an LED light source without replacement of the entire fixture.

Refer now to FIG. 7*a*-FIG. 8*b* for the next detailed description of the installation process. After removal of the above stated components from the legacy navigational running light fixture, the positioning tube 22 is then inserted into the lighting base 62. The positioning notch 36 should be positioned towards the bow of the ship or 0° (DEG). This step is critical for the eventual alignment and direction of the light leaving each specific navigational running light fixture. The seal 26 is then placed onto the stepped diameter of the positioning tube 22. The internal diameter defining the inner cylindrical side, of the seal 26 is sized slightly under the outer diameter defining the outer cylindrical side of the positioning tube 22 whereby causing a radial seal to the positioning tube 22. The securing ring 74 is then threaded onto the lighting base 62, whereby securing the positioning tube 22 and seal 26 to the lighting base 62. The seal 26 is shown with a round cross section, but may also be molded into various cross sections to cause a water tight seal between the positioning tube 22 and the lighting base 62.

Figure 8A:
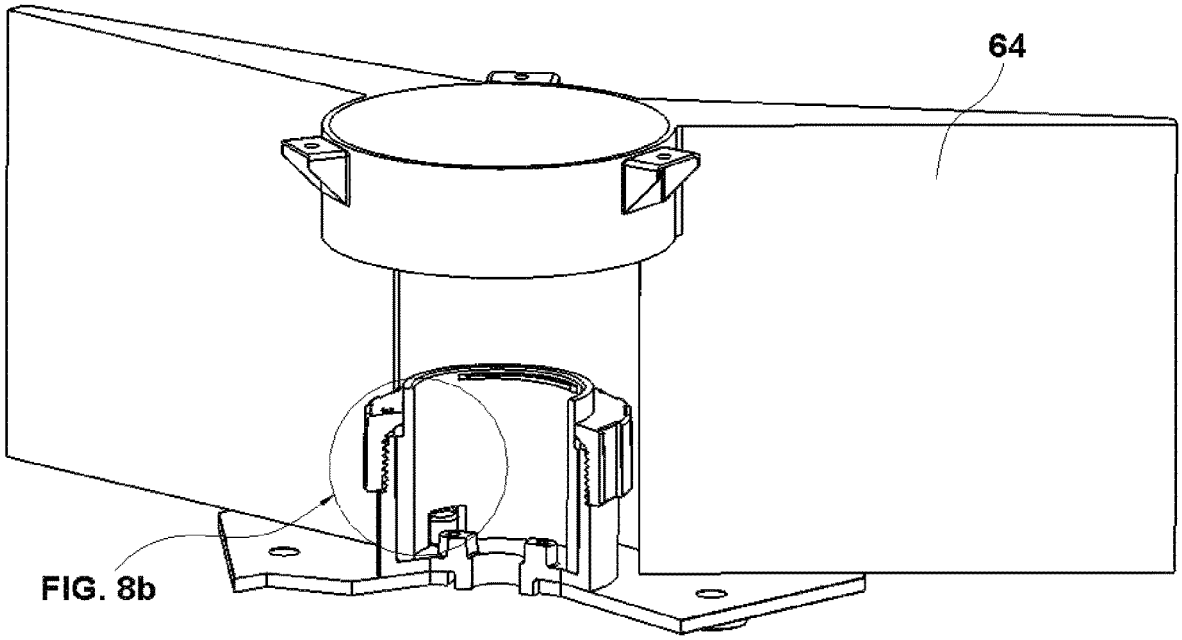
FIG. 8*a* is an isometric view of the positioning tube and seal fully installed into a legacy navigational running light fixture, partially cutaway to show the relative position and interaction with the legacy base component and sealing ring.
Figure 8B:
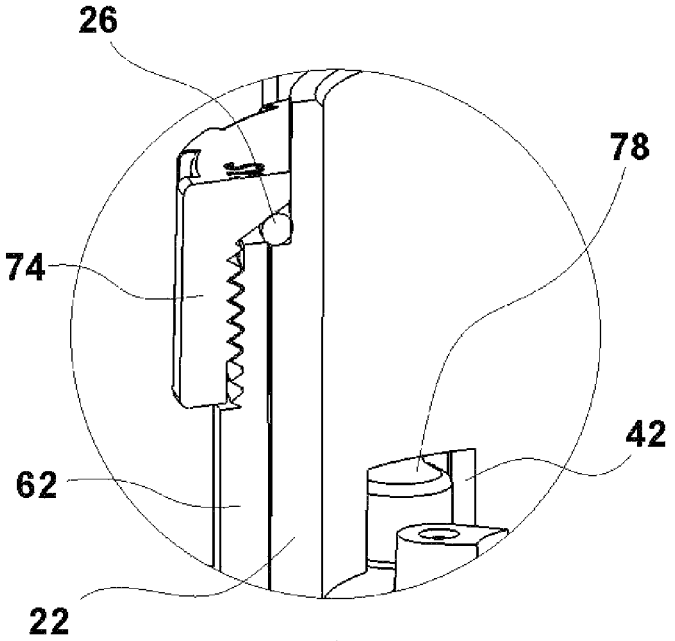
FIG. 8*b* is an enlargement of the encircled area of FIG. 8*a* labeled FIG. 8*b*.

As shown in FIG. 8*a*-8*b*, the positioning tube 22 is of such outer diameter to allow its insertion into the lighting base 62 while also allowing the seal 26 to compress on both the upper surface of the lighting base 62 and the stepped surface of the positioning tube 22 when the securing ring 74 is fully threaded onto the lighting base 62. The enlarged section view FIG. 8*b*, shows one of the three notches 42 of the positioning tube 22 positioned over one of the three bosses 78 at the lower floor of the lighting base 62. The notches 42 are sized and spaced to position around the bosses 78, whereby radially positioning the navigational running light retrofit system in a specific relationship to the navigational running light fixture. The notches 42 are also required to prevent the positioning tube 22 from any rotation after installation. Notches 42 are more broadly referred to as positioning elements and bosses 78 are more broadly referred to herein as lower positioning elements. It is understood that positioning elements and lower positioning elements may each comprise other features.

Figure 9:
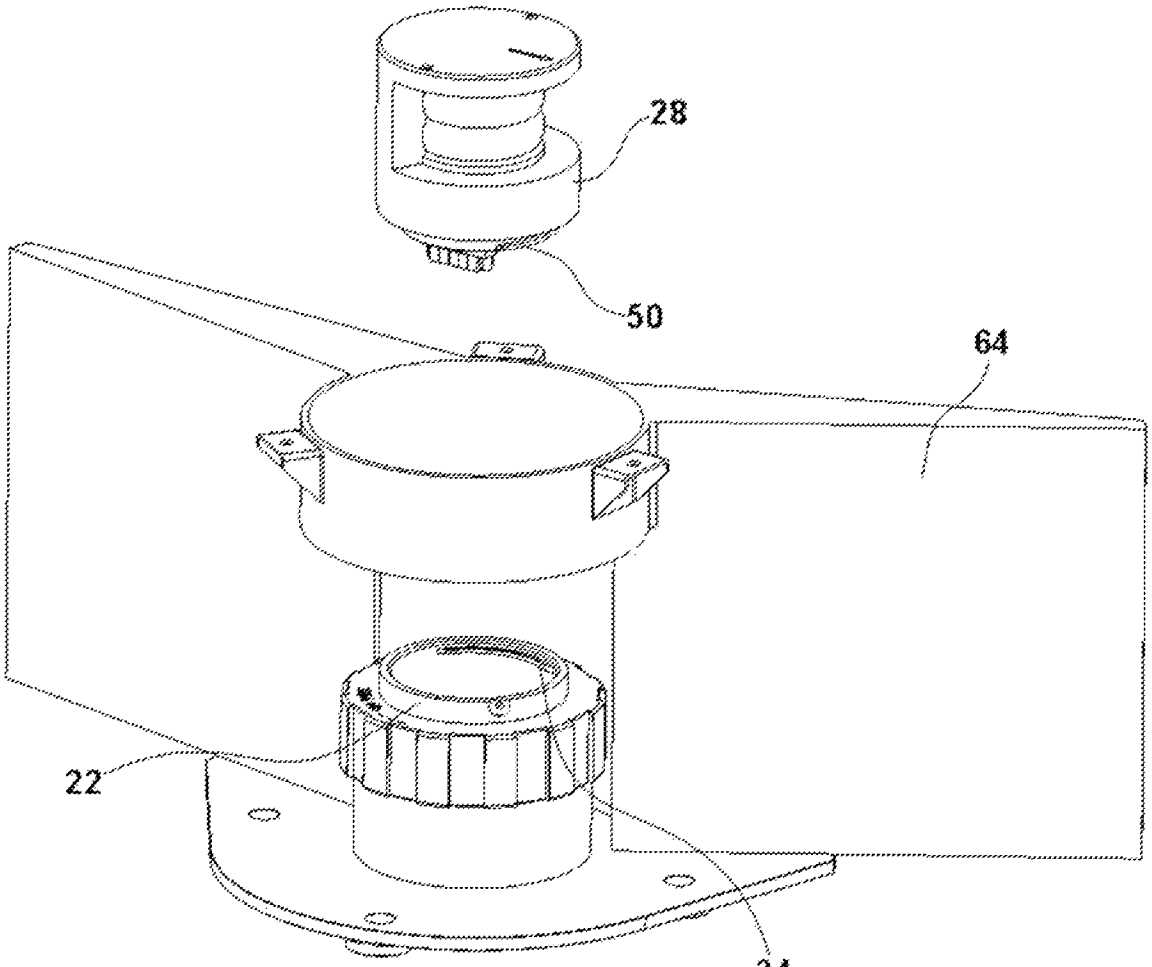
FIG. 9 is an isometric view of the LED light being installed into a legacy navigational running light fixture with positioning tube and seal in place and secured.

FIG. 9 shows the insertion of the exemplary LED light 28 through the top opening of the running light fixture housing 64. It is at this point in the installation process that the electrical connection between the LED light 28 and the existing power cable of the navigational running light fixture is made. After electrical connection is complete, the LED light 28 is positioned so that the radial helix geometry 50 is clocked 90° (DEG) from the helix geometry 34 of the positioning tube 22.

Figure 10A:
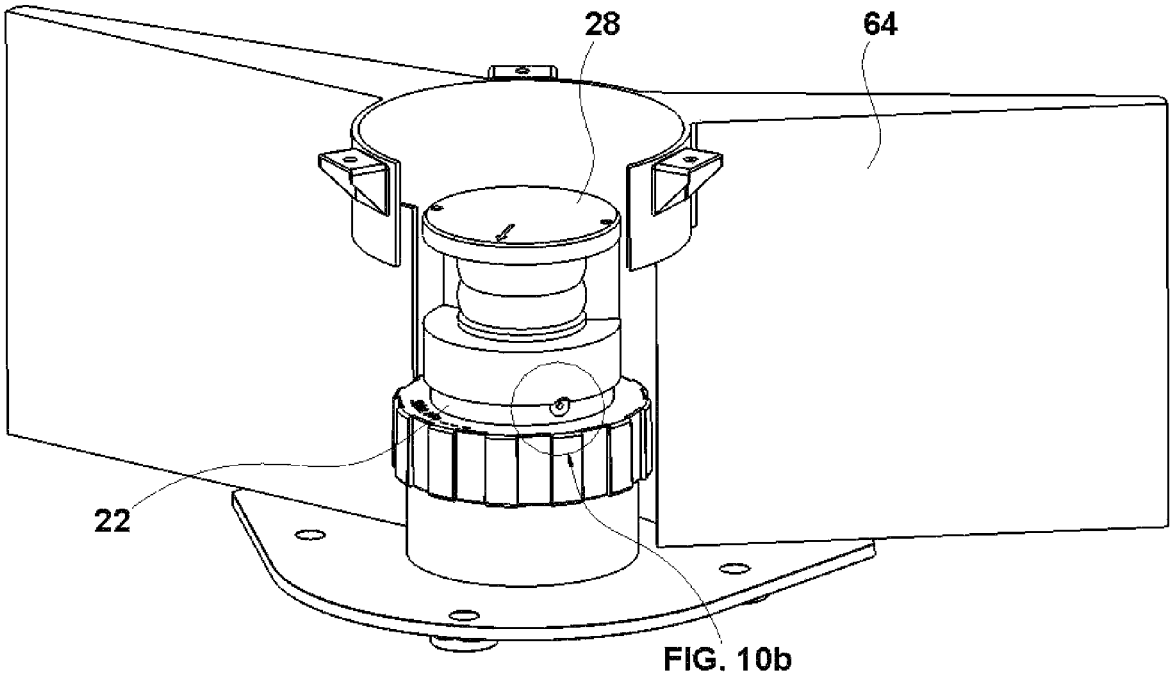
FIG. 10*a* is an isometric view of the LED light fully installed into a legacy navigational running light fixture. The top of the running light fixture has been partially cutaway to show the relative position.
Figure 10B:
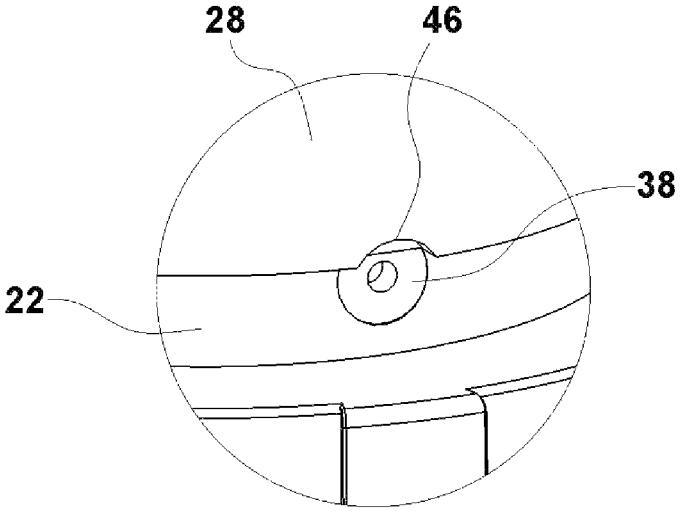
FIG. 10*b* is an enlargement of the encircled area of FIG. 10*a* labeled FIG. 10*b*.

Once the LED light 28, as shown in FIG. 10*a* is seated into the positioning tube 22, the LED light 28 is to be rotated clockwise until the positioning notch 46 is aligned and concentric with the concentric flat surface 38 of the positioning tube 22. FIG. 10*b* shows an enlarged view of this alignment. It is important to note that the embossed arrow on the top surface of the LED light 28 should be pointing towards the bow of the ship or 0° (DEG), regardless of the navigational running light fixture variant (masthead, side or stern light).

Figure 11:
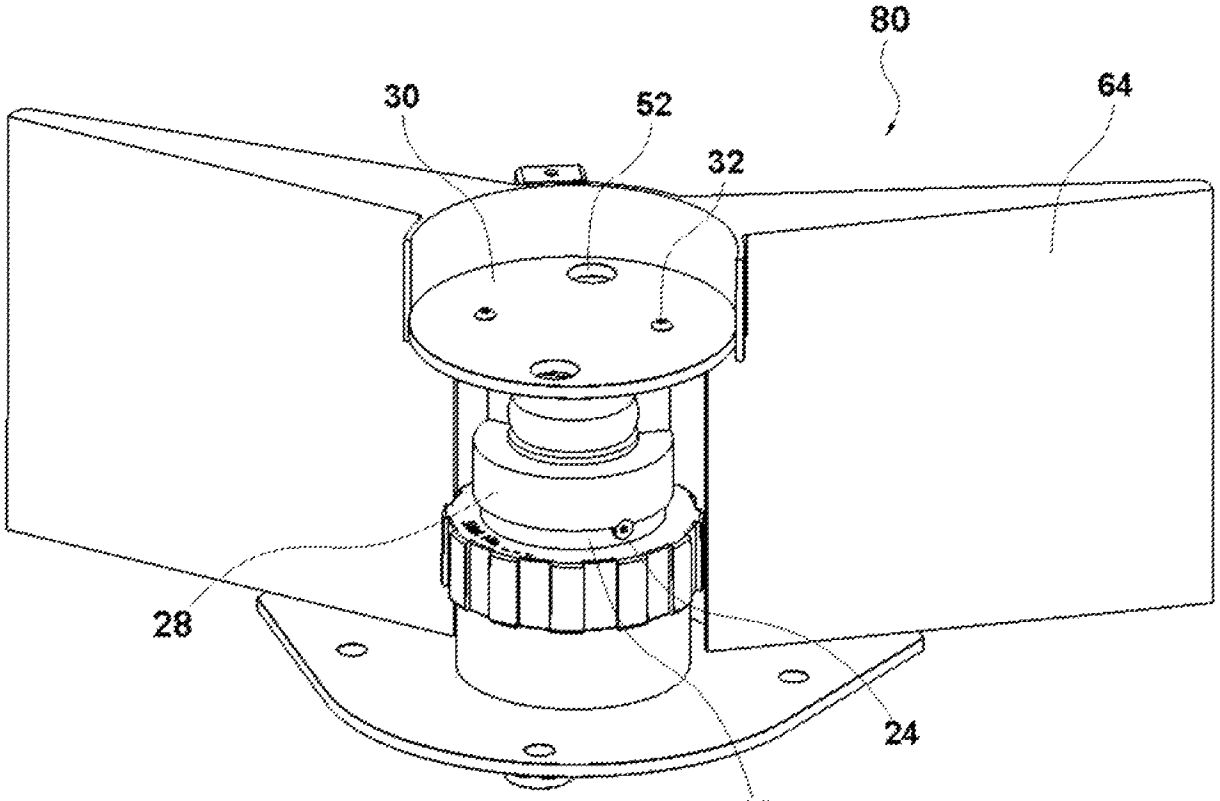
FIG. 11 is an isometric view of the fully installed retrofit system into a legacy navigational running light fixture. The top of the running light fixture has been partially cutaway to show the relative position of the assembly and interaction of the stabilizer plate to the fixture housing.

The positioning screw 24 is now threaded into the threaded hole 40 of the positioning tube 22. FIG. 11 shows the positioning screw 24 installed into the retrofit navigational running light fixture assembly 80. The stabilizer plate 30 is placed through the top of the navigational running light fixture housing 64 and positioned on the top surface of the LED light 28. Using the finger holes 52 of the stabilizer plate 30, the plate can be rotated until the threaded fasteners 32 can be inserted and threaded into the LED light 28. FIG. 11 also shows a partial cut away view of the upper housing 64 in order to show the relative position of the stabilizer plate 30 and the minimal gap between the outer diameter of the stabilizer plate 30 and the inner diameter of the upper portion of the navigational running light fixture housing 64. This gap must be less than 1/16" (0.062 inches) to maintain stability of the retrofit system under extreme mechanical shock, in which the retrofit system will experience shipboard.

Figure 12A:
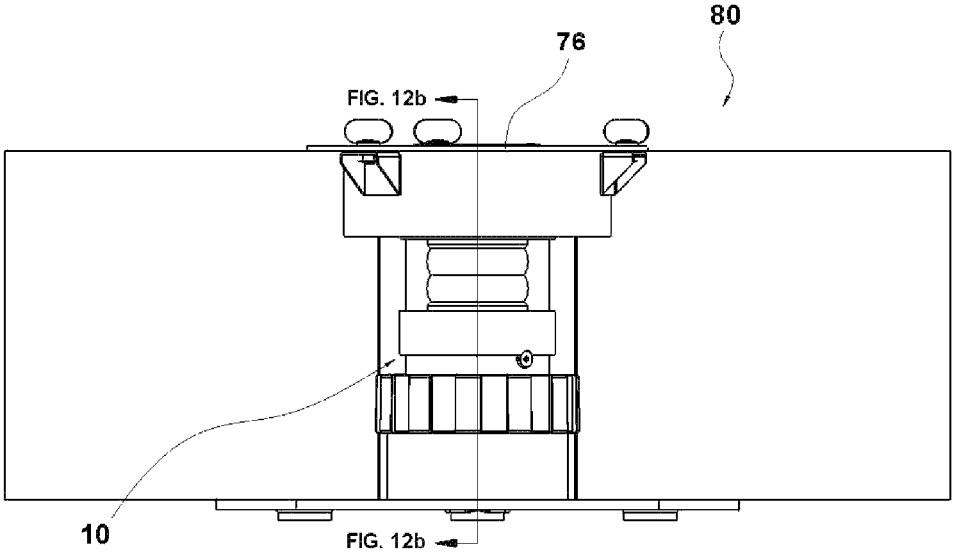
FIG. 12*a* is a front view of the retrofit system fully installed into a legacy navigational running light fixture.
Figure 12B:
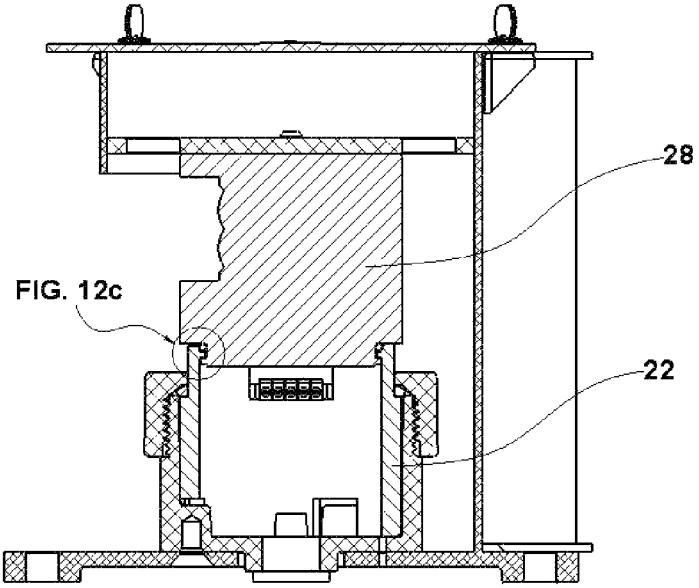
FIG. 12*b* is a section view of FIG. 12*a* taken at Arrows FIG. 12*b*-FIG. 12*b*.
Figure 12C:
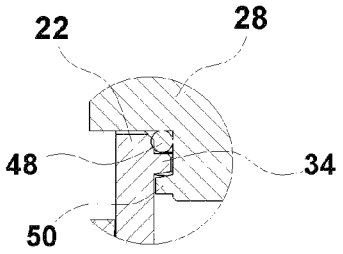
FIG. 12*c* is an enlargement of the circle portion of FIG. 12*b* labeled FIG. 12*c*.

FIG. 12*a* shows a front view of the fully retrofit navigational running light fixture assembly 80. The fixture housing cover 76 is now in place and secured. A cross section of the assembly, as shown in FIG. 12*b*, allows a view of the interaction between; the radial helix geometry 50 of the LED light 28, the O-ring seal 48 of the LED light 28, and the radial helix geometry 34 of the positioning tube 22. An enlarged view of this interaction is also shown in FIG. 12*c*. The surface of the helical geometry cooperates to pull the mating surfaces of the LED light 28 and the positioning tube 22 together upon clockwise rotation. The O-ring seal 48 is now compressed on four surfaces to cause a water-tight seal.

The navigational running light retrofit system 10 is now positioned, secured, and sealed using the components and structural elements of the existing navigational running light fixture. The navigational running light retrofit system 10 cooperates with the components and structural elements in a novel way to allow the light to be emitted from the LED light 28 to exit from the retrofit navigational running light fixture assembly 80 in the required angular direction, for each of the specific navigational running light fixture variants.

Certain embodiments of the navigational running light include the following:

(1) In a first embodiment, a navigational running light retrofit system for changing an incandescent light source to an LED light source, comprises:
   a) an LED navigational running light that has been modified from its commercial form to cooperate with the elements of the retrofit system as described herein;
   b) a stabilizer plate for maintaining structural stability of the retrofit system as described herein;
   c) an O-ring seal for arrangement between the LED light and a positioning tube;
   d) a positioning screw;
   e) a positioning tube having one or more locating elements that cooperate with the locating elements of the modified LED navigational running light to locate the positioning tube relative to the modified LED navigational running light, the locating elements of the positioning tube and the locating elements of the modified LED navigational running light each forming mechanical constraints to align and maintain alignment of the retrofit system for maintaining the desired direction and angle of an incandescent light exiting the navigational running light fixture for retrofit.

(2) In another embodiment of the navigational running light retrofit system according to the first embodiment under (1) the stabilizer plate is of similar diameter or of substantially the same diameter of the internal surface of the upper housing, such as of a U.S. Naval running light fixture as specified in U.S. military specification sheets MIL-L-24560/8, MIL-L-24560/9, and/or MIL-L-24560/10, each of which are hereby incorporated herein by reference.

(3) In another embodiment of the navigational running light retrofit system according to any embodiment under (1) or (2) above, the stabilizer plate has one or more through holes to allow assembly to the modified LED navigational running light using mechanical fasteners as described herein.

(4) In another embodiment of the navigational running light retrofit system according to any embodiment under (1) to (3) above, the stabilizer plate has one or more through holes to be used as finger holes that facilitate positioning on the top surface of the modified LED navigational running light as described herein.

(5) In another embodiment of the navigational running light retrofit system according to any embodiment under (1) to (4) above, the LED navigational running light has been modified to cooperate and align with the positioning tube, positioning screw, and stabilizer plate as described herein.

(6) In another embodiment of the navigational running light retrofit system according to any embodiment under (1) to (5) above, the positioning tube includes three lower positioning elements that cooperate with the internal features of the lighting base, such as is specified in U.S. military specification sheet MIL-L-24560/2 and/or U.S. military part number M24560/2-010, each of which are hereby incorporated herein by reference.

(7) In another embodiment of the navigational running light retrofit system according to any embodiment under (1) to (6) above, the positioning tube having a first outer cylindrical surface defined by a first outer diameter to allow insertion into the inner diameter of the lighting base, such as is specified in U.S. military specification sheet MIL-L-24560/2 and/or U.S. military part number M24560/2-010.

(8) In another embodiment of the navigational running light retrofit system according to any embodiment under (1) to (7) above, the positioning tube has a second outer cylindrical surface defined by a second outer diameter to allow insertion into the inner diameter of the securing ring, such as is specified in U.S. military specification sheet MIL-L-24560/2 and/or U.S. military part number M24560/2-011, which is hereby incorporated herein by reference.

(9) In another embodiment of the navigational running light retrofit system according to any embodiment under (1) to (8) above, the positioning tube has a step height between the first and second outer diameters which allow the compression of a seal between the surfaces of the securing ring, lighting base, and positioning tube.

(10) In another embodiment of the navigational running light retrofit system according to any embodiment under (1) to (9) above, the positioning tube being constructed with geometry on the inner cylindrical surface to allow the positioning and securing of an LED navigational running light to the top surface of the position tube.

(11) In another embodiment of the navigational running light retrofit system according to any embodiment under (1) to (10) above, the positioning tube having a single threaded hole on the second outer diameter to allow insertion of a positioning screw.

(12) In another embodiment of the navigational running light retrofit system according to any embodiment under (1) to (11) above, a positioning screw has a sufficient head diameter and height is configured to cooperate with elements as described herein of both the positioning tube and the modified LED navigational running light in tandem to form a mechanical constraint to align and maintain alignment between the positioning tube and the modified LED navigational running light.

Certain embodiments of the method of retrofitting a navigational running light fixture described herein include the following:

(1) A method of installing a navigational running light retrofit system as set forth herein, comprising of steps of:

(a) removing existing components from a navigational running light fixture being retrofit;

(b) installing the positioning tube component into the lighting base of the running light fixture being retrofit;

(c) installing the seal using the securing ring of the running light fixture being retrofit;

(d) installing a modified LED navigational running light to the positioning tube; and (e) installing a stabilizer plate to the modified LED navigational running light.

While various improvements have been described herein with reference to particular embodiments thereof, it shall be understood that such description is by way of illustration only and should not be construed as limiting the scope of any claimed invention. Accordingly, the scope and content of any claimed invention is to be defined only by the terms of the following claims, in the present form or as amended during prosecution or pursued in any continuation application. Furthermore, it is understood that the features of any specific embodiment discussed herein may be combined with one or more features of any one or more embodiments otherwise discussed or contemplated herein unless otherwise stated.

To the extent used, the terms "comprising," "including," and "having," or any variation thereof, as used in the claims and/or specification herein, shall be considered as indicating an open group that may include other elements not specified. The terms "a," "an," and the singular forms of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (i.e., not required) feature of the embodiments. Ranges that are described as being "between a and b" are inclusive of the values for "a" and "b" unless otherwise specified.

What is claimed is:

1. A navigational running light retrofit system for replacing an incandescent light source in a navigational running light fixture with an LED light source, comprising:

an LED navigational running light including the LED light source and being configured to be both (1) arranged within the navigational running light fixture above a positioning tube and (2) operably connected to a stabilizer plate, the LED navigational running light having one or more locating elements for arranging the LED navigational running light in an aligned configuration relative to the positioning tube;

the stabilizer plate being configured to be arranged within the LED navigational running light fixture for maintaining structural stability and positioning of the LED navigational running light within the navigational running light fixture;

an O-ring seal for arrangement between the LED light and a positioning tube;

a positioning screw; and the positioning tube being configured to fit within a lighting base of the navigational light fixture and be operably connected to the LED navigational running light, the positioning tube having one or more locating elements that cooperate with the one or more locating elements of the LED navigational running light to position the positioning tube relative to the LED navigational running light in the aligned configuration, the one or more locating elements of the positioning tube and the one or more locating elements of the LED navigational running light are each configured to engage the positioning screw and form mechanical constraints to align and maintain the LED navigational running light in the aligned configuration within the navigational running light fixture.

2. The navigational running light retrofit system according to claim 1, where the stabilizer plate is of similar diameter or of substantially the same diameter of an internal surface of an upper housing of the navigational running light fixture.

3. The navigational running light retrofit system according to claim 1, where, in being configured to be operably connected to the LED navigational running light, the stabilizer plate has one or more through holes for receiving a mechanical fastener.

4. The navigational running light retrofit system according to claim 1, where the stabilizer plate has one or more through holes or recesses to be used as finger holes that facilitate positioning on a top surface of the LED navigational running light.

5. The navigational running light retrofit system according to claim 1, where the positioning tube includes three lower positioning notches that cooperate with bosses arranged within the lighting base.

6. The navigational running light retrofit system according to claim 1, where in being configured for arrangement within the lighting base, the positioning tube has a first outer cylindrical surface defined by a first outer diameter to allow insertion into an inner diameter of the lighting base.

7. The navigational running light retrofit system according to claim 6, where the positioning tube has a second outer cylindrical surface defined by a second outer diameter to allow insertion into an inner diameter of a securing ring.

8. The navigational running light retrofit system according to claim 1, where the positioning tube has a step height between a first outer diameter and a second outer diameter, which allow the compression of a seal between the surfaces of a securing ring, a lighting base, and the positioning tube.

9. The navigational running light retrofit system according to claim 1, where the positioning tube is constructed with geometry on an inner cylindrical surface to allow the positioning and securing of the LED navigational running light to a top surface of the positioning tube using a securing ring of the navigational running light fixture.

10. The navigational running light retrofit system according to claim 1, where the positioning tube has a single threaded hole on a second outer diameter to allow insertion of the positioning screw.

11. The navigational running light retrofit system according to claim 1, where the positioning screw has a sufficient head diameter and height configured to cooperate with the one or more locating elements of the positioning tube and the one or more locating elements of the LED navigational running light to form a mechanical constraint to align and maintain alignment between the positioning tube and the LED navigational running light.

12. The navigational running light retrofit system according to claim 1, where the retrofit system is configured for use with a U.S. Naval running light fixture as specified in U.S. military specification sheets MIL-L-24560/8, MIL-L-24560/9, and/or MIL-L-24560/10, each of which are hereby incorporated herein by reference.

13. A method of retrofitting a navigational running light fixture to replace an incandescent light source contained in the fixture with an LED light source, the method comprising of steps of:

providing a retrofit system comprising:

an LED navigational running light including the LED light source and being configured to be both (1) arranged within the navigational running light fixture above a positioning tube and (2) operably connected to a stabilizer plate, the LED navigational running light having one or more locating elements for arranging the LED navigational running light in an aligned configuration relative to the positioning tube;

the stabilizer plate being configured to be arranged within the LED navigational running light fixture for maintaining structural stability and positioning of the LED navigational running light within the navigational running light fixture;

an O-ring seal for arrangement between the LED navigational running light and the positioning tube;

a positioning screw; and a positioning tube being configured to fit within a lighting base of the navigational light fixture and be operably connected to the LED navigational running light, the positioning tube having one or more locating elements that cooperate with the one or more locating elements of the LED navigational running light to position the positioning tube relative to the LED navigational running light in the aligned configuration, the one or more locating elements of the positioning tube and the one or more locating elements of the LED navigational running light are each configured to engage the positioning screw and form mechanical constraints to align and maintain the LED navigational running light in the aligned configuration within the navigational running light fixture;

removing the incandescent light source from the navigational running light fixture being retrofit;

installing the positioning tube into the lighting base of the navigational running light fixture being retrofit;

installing the O-ring seal along the positioning tube and a securing ring of the running light fixture being retrofit to the lighting base to secure the positioning tube within the lighting base and compress the O-ring between the securing ring and the lighting base;

installing the LED navigational running light to the positioning tube; and connecting operably the stabilizer plate to the LED navigational running light.

14. The method according to claim 13, where the stabilizer plate is of similar diameter or of substantially the same diameter of an internal surface of an upper housing of the navigational running light fixture.

15. The method according to claim 13, where the positioning tube includes three lower positioning notches that cooperate with bosses arranged within the lighting base.

16. The method according to claim 13, where the positioning tube is constructed with geometry on an inner cylindrical surface to allow the positioning and securing of an LED navigational running light to a top surface of the positioning tube.

17. The method according to claim 13, where the positioning screw has a sufficient head diameter and height configured to cooperate with the one or more locating elements of the positioning tube and the one or more locating elements of the LED navigational running light to form a mechanical constraint to align and maintain alignment between the positioning tube and the modified LED navigational running light.

18. The method according to claim 13, where the retrofit system is configured for use with a U.S. Naval running light fixture as specified in U.S. military specification sheets MIL-L-24560/8, MIL-L-24560/9, and/or MIL-L-24560/10, each of which are hereby incorporated herein by reference.

19. The navigational running light retrofit system of claim 1, where the positioning tube is configured to be secured within the navigational running light fixture by a securing ring of the navigational running light fixture.

* * * * *